US007731485B2

(12) United States Patent
Achten

(10) Patent No.: US 7,731,485 B2
(45) Date of Patent: Jun. 8, 2010

(54) RECIPROCATING CYLINDER SWASH PLATE PUMP

(75) Inventor: Peter A. J. Achten, Eindhoven (NL)

(73) Assignee: Innas B.V. (NL)

( * ) Notice: Subject to any disclaimer, the term of this patent is extended or adjusted under 35 U.S.C. 154(b) by 738 days.

(21) Appl. No.: 11/355,031

(22) Filed: Feb. 15, 2006

(65) Prior Publication Data

US 2006/0222516 A1 Oct. 5, 2006

Related U.S. Application Data

(63) Continuation-in-part of application No. 10/889,288, filed on Jul. 12, 2004, now abandoned, which is a continuation of application No. PCT/NL03/00015, filed on Jan. 10, 2003.

(51) Int. Cl.
*F04B 1/12* (2006.01)
*F01B 1/12* (2006.01)

(52) U.S. Cl. ..... 417/269; 92/71; 91/500; 91/502

(58) Field of Classification Search ..... 417/269, 417/222.2, 222.1, 534; 91/505, 504, 499, 91/500, 502; 92/71
See application file for complete search history.

(56) References Cited

U.S. PATENT DOCUMENTS

| | | | | |
|---|---|---|---|---|
| 3,434,429 | A | 3/1969 | Goodwin | |
| 3,648,567 | A | 3/1972 | Clark | |
| 3,958,496 | A * | 5/1976 | Wallin | 91/506 |
| 4,361,077 | A | 11/1982 | Mills | |
| 4,703,682 | A | 11/1987 | Hansen | |
| 5,415,530 | A * | 5/1995 | Shilling | 417/269 |
| 5,636,561 | A * | 6/1997 | Pecorari | 91/499 |
| 5,794,514 | A | 8/1998 | Pecorari | |
| 6,293,768 | B1 * | 9/2001 | Shintoku et al. | 417/312 |

FOREIGN PATENT DOCUMENTS

| | | |
|---|---|---|
| DE | 2 130 514 | 12/1972 |
| DE | 35 19 783 | 12/1986 |

* cited by examiner

*Primary Examiner*—Devon C Kramer
*Assistant Examiner*—Todd D Jacobs
(74) *Attorney, Agent, or Firm*—St. Onge Steward Johnston & Reens LLC

(57) ABSTRACT

The invention relates to a hydraulic device having, in a housing, a rotor, which can rotate about a first axis, with pistons and chambers on both sides of the rotor, which can rotate about a second axis and are formed by a cylindrical wall and a piston. The cylindrical walls are rotatable about a second axis ($m_1$ and $m_2$) and the first axis, such that, during rotation of the rotor, the volumes of the rotor chambers on one side of the rotor and the rotor chambers on the other side of the rotor alternatively have a minimum value.

4 Claims, 8 Drawing Sheets

RECIPROCATING CYLINDER SWASH PLATE PUMP

CROSS-REFERENCE TO RELATED APPLICATIONS

This application is a continuation-in-part of pending U.S. application Ser. No. 10/889,288 filed Jul. 12, 2004 which is a continuation of International Patent Application No. PCT/NL2003/000015 filed Jan. 10, 2003 which designates the United States and claims priority of Dutch Patent Application Nos. 1019736 filed Jan. 12, 2002 and 1020932 filed Jun. 24, 2002.

FIELD OF THE INVENTION

The invention concerns a hydraulic device comprising of a housing, a rotor rotatable about a first axis (l), said rotor having a first side and a second side, a plurality of pistons on said first side and said second side of the rotor and coupled to the rotor, the rotor chambers being formed by a cylindrical wall and the pistons whereby the cylindrical walls are rotatable about a second axis ($m_1$, $m_2$) and the first axis intersecting each second axis on either side of the rotor under a first angle ($\beta$) causing the volume of the chambers to change between a minimum and a maximum value during rotation of the rotor. Such a device is known from U.S. Pat. No. 3,434,429 Goodwin. In the disclosed hydraulic device the minimum value of the chamber volumes on both sides of the rotor is reached at the same moment causing fluctuations in fluid flow which is similar to fluctuations as observed in hydraulic devices with a number of pistons that is equal to the number of pistons on one side of the rotor. The invention aims to decrease these fluctuations and therefore during rotation of the rotor the volumes of the rotor chambers on said first side of the rotor and said second side of the rotor alternately have a minimum value. In this way the hydraulic device behaves as a device with a number of pistons equal to the total of pistons on both sides with the added advantage that the load on the rotor is more or less balanced.

In accordance with an embodiment of the invention the hydraulic device is designed such that the first axis (l) and the second axes ($m_1$, $m_2$) are in a common plane (V) and the pistons on either side of the rotor are arranged offset to one another. This makes it possible to make the housing completely symmetric, which reduces the number of different parts.

In accordance with an embodiment of the invention the hydraulic device is designed such that a first plane ($V_1$) is formed by the first axis (l) and one of the second axes ($m_1$) and a second plane ($V_2$) is formed by the first axis and the other second axis ($m_2$) and the first plane ($V_1$) and the second plane ($V_2$) make a second angle ($\alpha$) with one another. This makes it possible to have pistons on both sides of the rotor in line, so that it is possible to mount them easier in the rotor.

In accordance with an embodiment of the invention the hydraulic device is designed such that the number of pistons on either side of the rotor is equal to n, the second angle ($\alpha$) is equal to $(1+2k)*180°/n$, where k is equal to 0 or an integer number. In this way the fluctuations in fluid flow are evenly distributed over a rotation.

BRIEF DESCRIPTION OF SEVERAL VIEWS OF THE DRAWINGS

The invention is explained below with reference to a number of exemplary embodiments and with the aid of a drawing, in which.

DETAILED DESCRIPTION OF THE INVENTION

Figure 1:
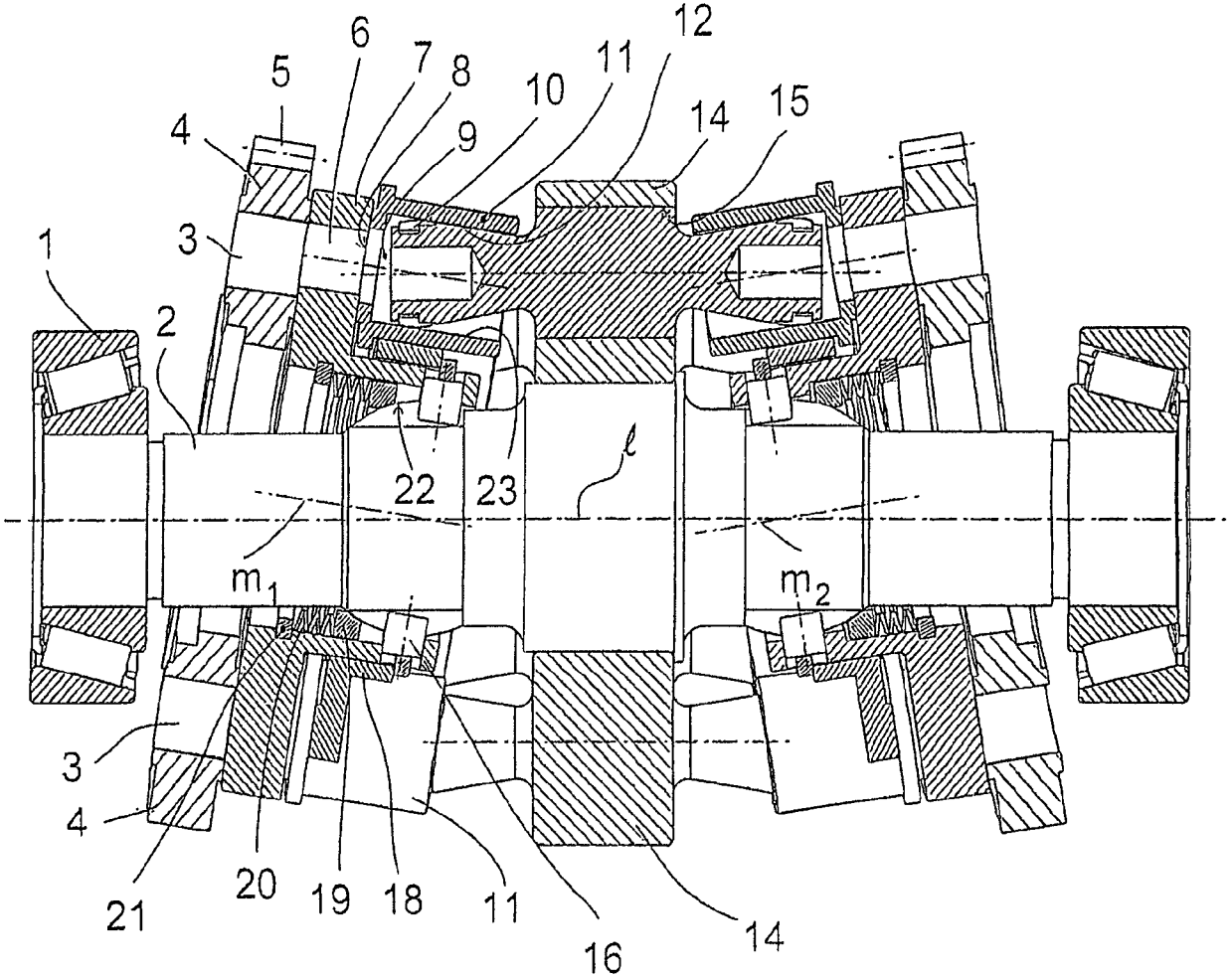
FIG. 1 shows a cross section through the interior of a hydraulic device.
Figure 2:
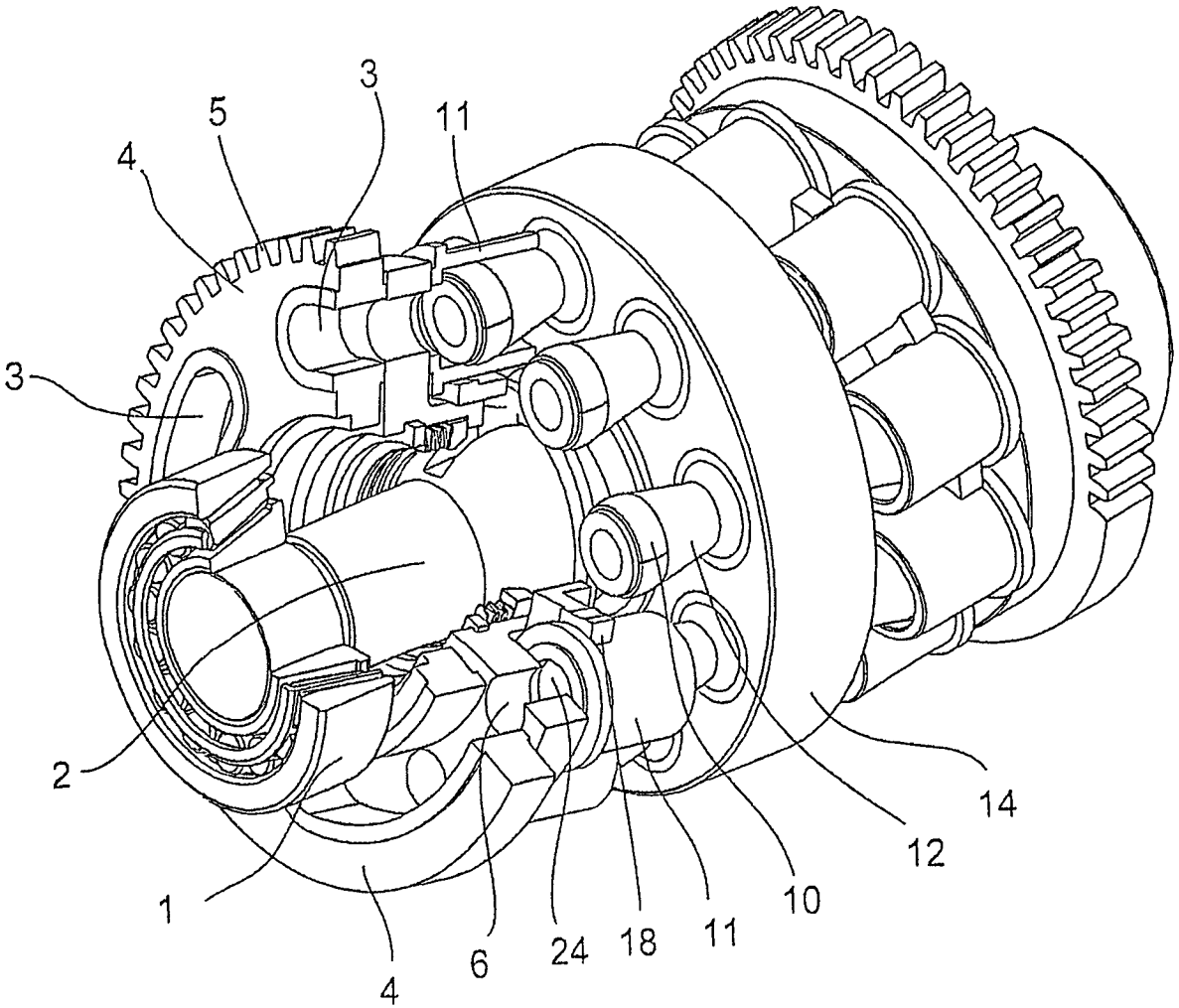
FIG. 2 shows a perspective view of the hydraulic device shown in FIG. 1.

The components shown in FIGS. 1 and 2 are the parts of a hydraulic transformer which are mounted in a housing. A hydraulic transformer of this type is described, for example, in the published applications WO 9731185 and WO 9940318, the contents of which are deemed to be known. Bearings 1 in which a rotor shaft 2 having an axis l can rotate are mounted in the housing in a known way. A rotor 14 with rotor holes 15 is mounted on the rotor shaft 2. In the rotor holes 15 there are rod-like components which form pistons 12 on either side of the rotor 14. The pistons 12 are provided with piston rings 10, the outer surface of the piston rings 10 being convex in shape, and the centre of this convexity lying in a single plane for all the pistons on one side of the rotor 14. If appropriate, the outer surface of the piston rings 10 is arched. The left-hand side and the right-hand side of the rotor 14 are symmetrical with respect to the centre of the rotor 14. Each side of the rotor 14 interacts with a drum plate 7 with drum sleeves 11 which rotate about an axis $m_1$ and $m_2$, the axes l and $m_1$ and l and $m_2$, respectively, intersecting one another in the plane perpendicular to l through the centre points of the outer surfaces of the piston rings 10 for the pistons 12 located on that side.

On the rotor shaft 2 there is a centering surface 22 about which the drum plate 7 can pivot. The centering surface 22 is convex, the centre of the convexity lying in the plane on which the centre of the convex piston rings 10 lies. The rotation of the drum plate 7 is coupled to the rotation of rotor shaft 2 by means of a key 16 which engages in a keyway. In the plane of the surface of the shaft, the key 16 has a rounding radius which is smaller than the radius of the centering surface 22, so that the key 16 does not become jammed in the keyway when the drum plate 7 rotates. If appropriate, there may be more than one key 16. It is also possible for the key 16 to be mounted in the rotor shaft 2 and for the keyway to be arranged in the drum plate 7.

On the side which faces the pistons 12, the drum plate 7 is provided with drum sleeves 11 which are clamped against the drum plate 7 by a sleeve holder 18. On the inner side, the drum sleeve 11 has a cylindrical wall 23. Each piston 12 is surrounded by a drum sleeve 11, it being possible for the piston ring 10 to move in a sealed manner along the cylindrical wall 23. The piston 12 and the cylindrical sleeve 11 therefore form a chamber 9, the volume of which changes when the rotor shaft 2 rotates. The change in volume causes oil flow into and out of the chamber 9 via a drum sleeve opening 24, a drum port 6 and a drum-plate port 3 to an opening in the housing. The corresponding drum-plate ports 3 are connected to one another in the housing. Since the axes of rotation of the rotor 14 and the drum plate 7 form an angle with respect to one another, the pistons 12 in the plane of the drum plate 7 describe an elliptical path, and the drum sleeves 11 will slide over a contact surface 8 of the drum plate 7. The holder 18 is designed with openings which allow this sliding to take place, and it also ensures that the gap between drum plate 7 and drum sleeve 11 remains limited, so that pressure can build up in the chamber 9 when starting up. In another embodiment, it is also possible for the holder 18 to be secured in such a manner to the drum plate 7 that the rotation of the rotor 14 is transmitted via the pistons 12, the drum sleeves 11 and the holder 18 to the drum plate 7, with the result that the key 16 and the associated keyway can be dispensed with.

The face-plate port 3 is arranged in a face plate 4 which is supported against a surface of the housing.

This surface is not at right angles to the axis l, but rather forms and angle therewith, thus determining the direction of the axis m1 or m2 and therefore also the rotational position at which the volume in the chamber 9 is at its minimum or maximum. The face plate 4 is secured in the housing in such a manner that it can rotate about the axis m1 or m2 and is provided over part of its circumference with toothing 5 which interacts with a pinion driven by a drive. A centering sleeve (not shown) can be used to centre the rotation of the face plate 4 in the housing in a known way. Rotation of the face plate 4 causes the setting of the hydraulic transformer to change, as described in the patent applications which were cited earlier in the text.

To keep the openings between face plate 4 and drum plate 7 small during starting up, when there is as yet no pressure in the chambers 9, there is a pressure-exerting ring 19 which is supported against the centering surface 22. Between the pressure-exerting ring 19 and a ring 21 secured in the drum plate 7 there are cup springs 20, by means of which the drum plate 7 is always pressed onto the face plate 4. If appropriate, other resilient elements may be used instead of cup springs 20.

Figure 3:
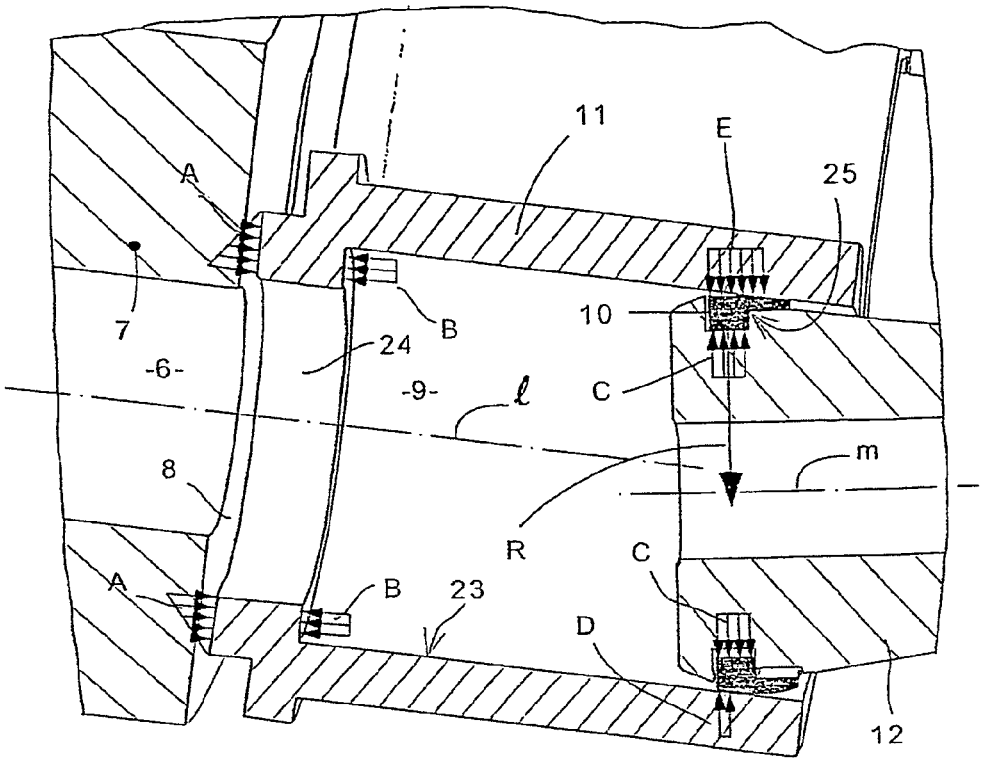
FIG. 3 shows a detail from FIG. 1 including the forces acting on the drum sleeve.

FIG. 3 shows the drum sleeve 11, which is supported on the contact surface 8 of the drum plate 7. During use, a high pressure prevails in the chamber 9 and the drum port 6, while a lower pressure prevails outside the drum sleeve 11. A changing oil pressure will form in the gap in the contact surface 8 between drum sleeve 11 and drum plate 7, as indicated by arrows A in the figure. To prevent the size of the gap from increasing under the influence of this oil pressure, the drum-sleeve opening 24 has a smaller surface area than the sealing surface of the piston 12 in the cylindrical wall 23. There is now a rim around the drum-sleeve opening 24, on which oil pressure, indicated by arrows B, exerts a force on the drum sleeve 11 in the direction of the contact surface 8. If the drum sleeve 11 is dimensioned correctly, it is possible to ensure that under the influence of the oil pressure the drum sleeves 11 are always pressed onto the contact surface 8.

The forces acting on the piston ring 10 are also shown in FIG. 3. On the outer side, the piston ring 10 has a convex surface, so that the seal between piston ring 10 and the cylindrical surface 23 is produced in the plane which is perpendicular to the cylindrical surface 23, i.e. perpendicular to the axis m. If appropriate, the surface may be arched rather than circularly convex. The piston ring 10 is not subject to uniform load all the way around as a result of the angles between the axes 1 and m, since the surface area which is under high pressure on the outer side as a result of oil is large at E, as indicated by arrows, and is small at D. Since the surface area which is under pressure is small at D, the piston ring 10, under the influence of the pressure on the inner side, which is indicated by the arrows C, could press heavily on the cylindrical wall 23 and cause a high frictional force.

This frictional force is greatly reduced through the fact that the inner side of the piston ring 10 is designed with a shoulder 25. If this shoulder 25 lies halfway along the width of the piston ring 10, the outwardly directed force is halved. As shown, the inwardly directed force at E is greater than the outwardly directed force. Under the influence of this, the piston ring 10 is supported on the piston 12, while as a result of the displacement of the drum sleeve 11 the seal between piston ring 10 and cylindrical wall 23 is retained all the way around. As a result of the support, the piston ring 10 exerts a resulting force R on the piston 12, and this force R drives the rotor 14.

Obviously, it is also possible for the device to be fitted without piston rings 10, but in this case it will be necessary to take measures to avoid contamination which may cause wear.

The hydraulic transformer is designed in such a manner that the pistons 12 on either side of the rotor 14 alternately move into the top dead centre, i.e. the position where the volume of the chambers 9 is at its minimum, so that in terms of fluctuations in the oil flow and the torque acting on the rotor 14, it is possible to count on the total number of pistons 12, i.e. eighteen pistons 12 in the example shown. In the exemplary embodiment shown, in which the pistons 12 on either side of the rotor 14 lie in line with one another, this is achieved by rotating the top dead centre of the pistons on one side through an angle $\alpha$ with respect to the top dead centre on the other side.

In this case, $\alpha$ is equal to half the rotational angle between two pistons 12. The face plates 4 are also rotated through this angle with respect to one another.

Figure 4A:
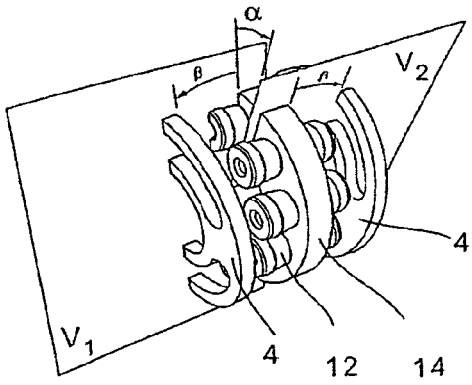
FIGS. 4*a* and 4*b* diagrammatically depict the planes through the axes of the rotor and the drum plate.
Figure 4B:
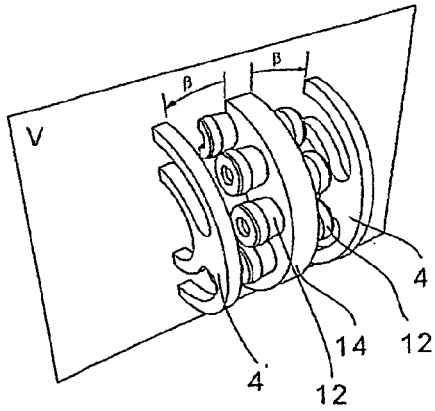

This is shown in FIG. 4*a*, in which V1 is the plane through the axes l and m2, and V2 is the plane through the axes l and m2. Another embodiment is shown in FIG. 4*b*. In this case, the axes l, m1 and m2 lie in a plane V and the pistons 12 are arranged offset in the rotor 14. This embodiment is of interest in particular if the volumes of the chambers 9 which successively acquire a maximum volume are coupled through passages with valves as discussed in applications WO 0244524 and WO 0244525. In the embodiment shown in FIG. 4*b*, axes of the pistons 12 are parallel to the axis l, and the pistons on either side are different components which are arranged offset in the rotor 14. In an embodiment which is not shown and in which the pistons 12 on either side of the rotor 14 are offset and the axes l, m1 and m2 likewise lie in one plane, the pistons 12 on either side are made from a component which is mounted in the rotor 14 and has an axis which forms an angle with the axis l.

It is preferable for the rotation of the two face plates 4 to be coupled, so that only one drive is required. This is achieved, for example, by rotating the face plates 4 using a gearwheel, coupled to a shaft and coupling the two shafts to a homokinetic coupling, so that the rotation of the two face plates is accurately synchronous. If appropriate, the two face plates 4 may be provided with their own drive, so that for certain operating states a hydraulic preloading can be obtained.

The angle $\beta$ between the axes l and m determines the displacement of the device. In the embodiment shown, with 9 pistons 12 on each side, the angle is 9 degrees.

If the number of pistons 12 increases, this angle has to be smaller, since otherwise the constriction of piston 12 which is required in order always to remain clear of the drum sleeve 11 becomes too great. In the embodiment shown, calculations have been based on a maximum rotational speed of the rotor 14 of 8000 revolutions per minute. If this speed is greater, a smaller angle β is required in order to prevent the occurrence of unacceptable pressure peaks.

In the exemplary embodiment shown, it is shown that the drum plate 7 is centered by means of the centering surface 22. It is also possible for this centering to be designed in other ways, for example by providing the drum plate 7 with a spherical bearing on its outer circumference, which is secured in the housing. Another embodiment may involve the drum plate 7 being centered with respect to the face plate 4, for example by providing the latter with a conical shape. It is also possible for a centering sleeve to be positioned in the housing in order to centre both the face plate 4 and the drum plate 7.

Figure 5:
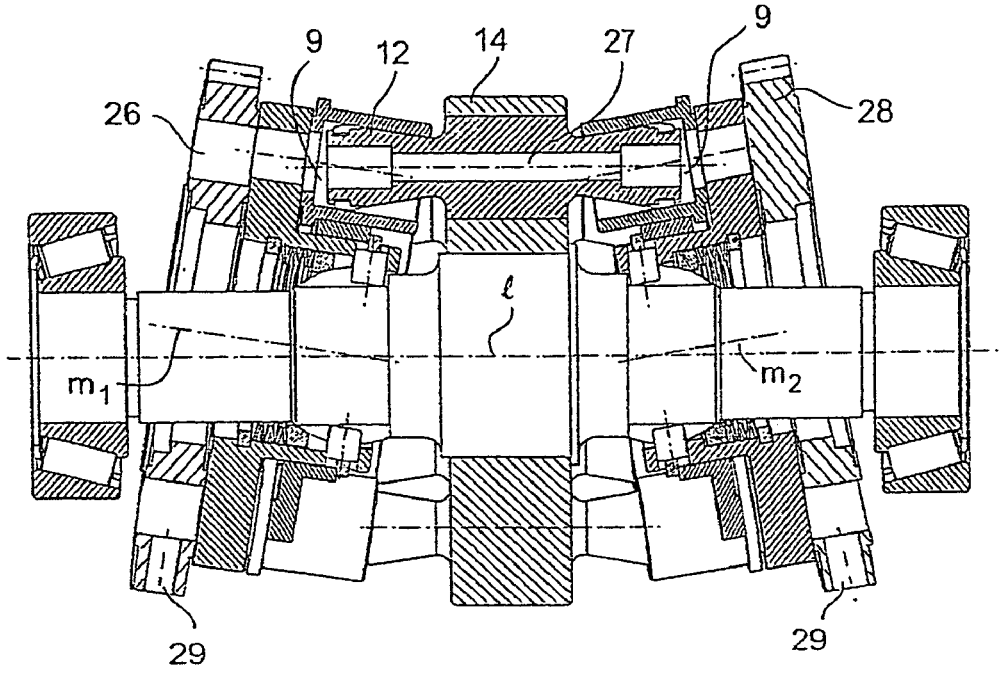
FIG. 5 shows a second embodiment of the hydraulic device.

FIG. 5 shows another embodiment of the hydraulic transformer. In this case, the axes l, m1 and m2 of the rotor 14 and both drums may lie in a single plane, although it is also possible for them to be designed as shown in FIG. 4*a*. The chambers 9 on either side of the rotor 14 are connected to one another by a passage 27 running through the pistons 12. Face plates 26 and 28 are designed in such a manner that the face-plate port 3 leading to the tank connection is directly connected to the interior of the housing via a passage 29, this interior being connected to the tank connection. The face plates 26 and 28 are designed in such a manner that of the remaining two face-plate ports 3, each face plate 26 or 28 has one of the two ports and is closed at the location of the other port.

This makes it possible for the connection in the housing to have an opening to the face plate over a wide angle and enables the face plates to rotate through a large angle, with the result that the control range of the hydraulic transformer is increased in a simple manner through rotation of the face plate. The rotation of the face plates 26 and 28 is coupled in the manner described above.

Figure 13:
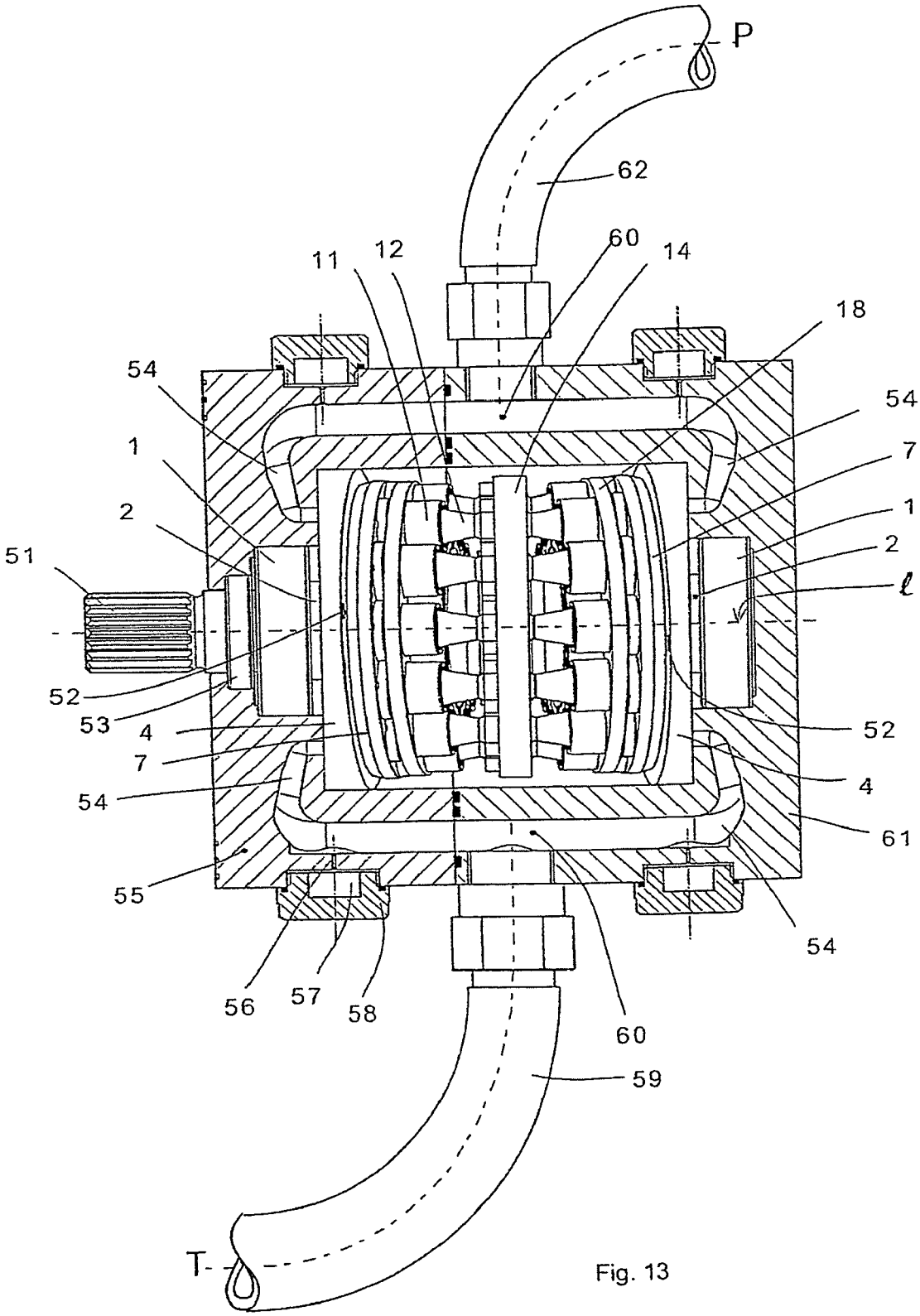
FIG. 13 shows a first embodiment of a pump or motor.
Figure 14:
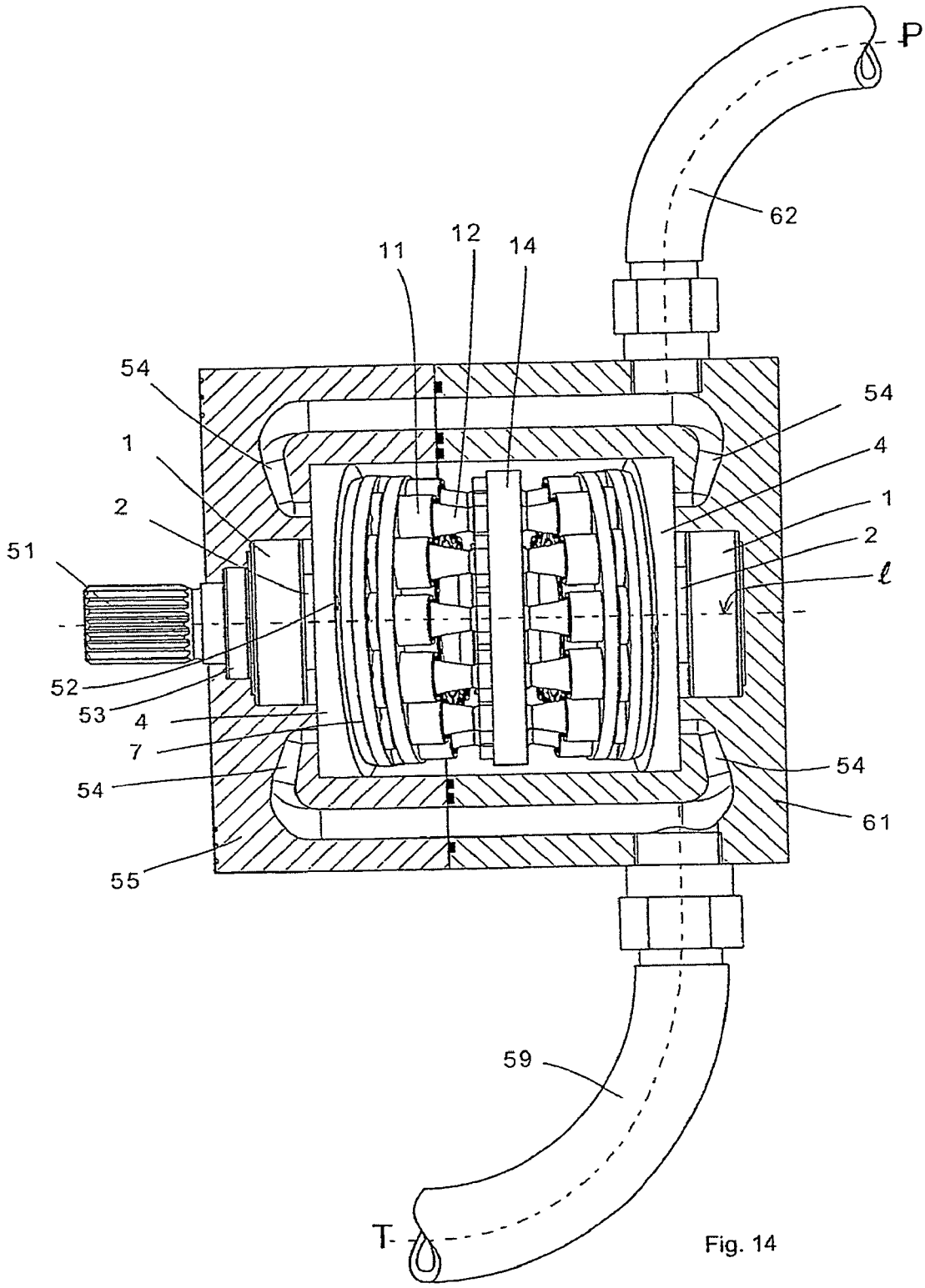
FIG. 14 shows a second embodiment of a pump or motor.

In the exemplary embodiments given above, the device has been described as a hydraulic transformer. It will be clear to the person skilled in the art that the device can be made suitable for use as a pump or a motor with only minor adjustments, such as, inter alia, to the face plates 4 and the rotor shaft 2. Examples of this are shown in FIGS. 13 and 14, which will be discussed later on in the text.

Figure 6:
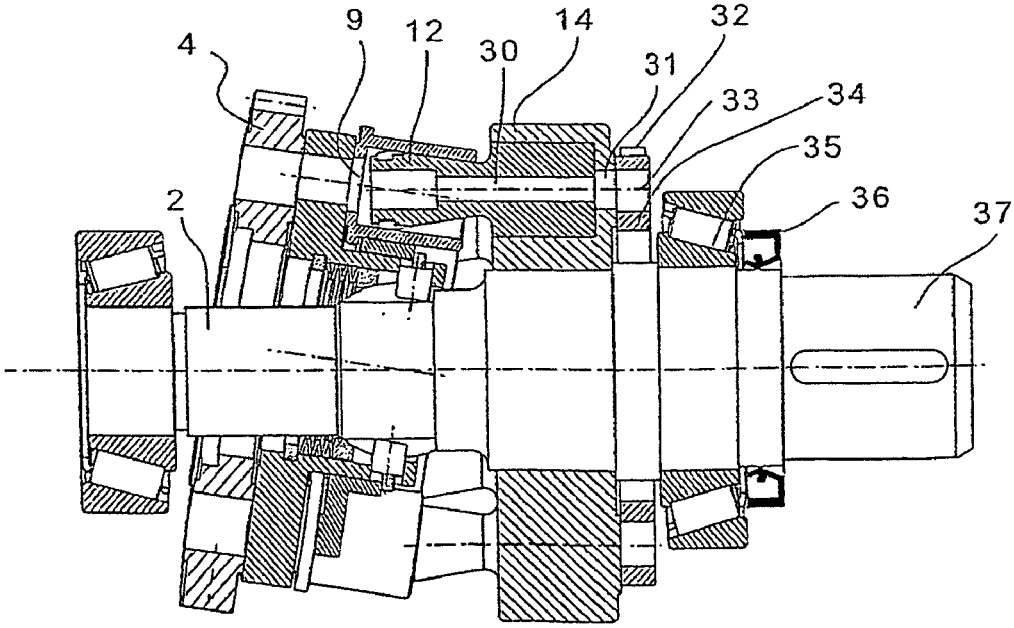
FIG. 6 shows a hydraulic device according to a third embodiment.

FIG. 6 shows an exemplary embodiment in which pistons 12 are accommodated on only one side. Their design corresponds to that which has been described in the embodiment shown in FIGS. 1 and 2. For axial balancing of the rotor 14, the latter is provided, on the side remote from the piston, with a face plate 34.

On the side of the face plate 34, the rotor 14 is provided with chambers 31 which, via a passage 30, are in communication with the chambers 9. The surface area of the chambers 31 is comparable to the sealing surface area of the pistons 12, so that the rotor 14 is balanced in the axial direction.

The face plate 34 may be designed without face-plate ports. In one embodiment, there may also be face-plate ports 33, which are in communication with passages in the housing. This makes it possible to reduce pulses in the liquid flow and liquid pressure, because the flow of liquid to and from the chamber 9 take place via two face plates.

In the exemplary embodiment shown in FIG. 6, the rotor shaft 2 has been lengthened to outside the housing and ends at a shaft end 37. The rotor shaft 2 is for this purpose provided with a seal 36 and a bearing 35. This embodiment is particularly suitable for use as a pump or motor.

In the exemplary embodiments discussed above, the angles between the axes are constant and the displacement is varied through rotation of the face plates. Obviously, the design of the rotor with the fixedly mounted pistons and the drum plate with the drum sleeves which can be displaced perpendicular to the axis of the drum plate can also be used in embodiments in which the axis of the drum plate can pivot with respect to the axis of the rotor.

Figure 7:
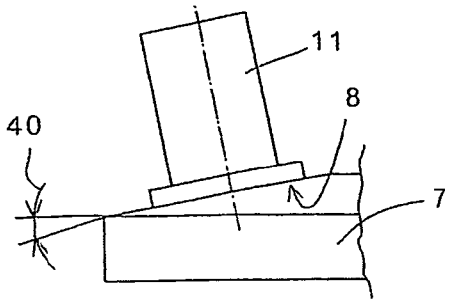
FIGS. 7 and 8 show a detail of an embodiment of the drum plate.
Figure 8:
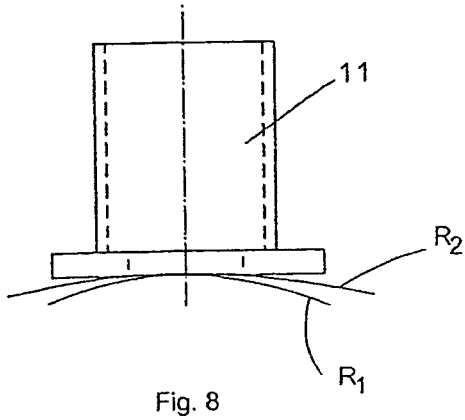

FIGS. 7 and 8 show a modified embodiment of the drum plate 7 which simplifies the sliding of the drum sleeves 11 over the contact surface 8. To reduce the resistance during the sliding movement of the drum sleeves 11 over the drum plate 7, it is necessary for a film of oil to be present between the drum sleeve 11 and the drum plate 7, even when the rotor 14 is stationary, so that the starting of the rotation of the rotor 14 is impeded to the minimum possible extent. To promote the formation of a film of oil of this type, the contact surface 8 has a curvature in one direction, so that there is linear contact between the drum sleeves 11 and the drum plate. For this purpose, the contact surface 8 is preferably designed as a cone with an angle 40 of 0.3 degree with a tolerance of 0.1 degree. The drum sleeve 11 now rests against a curved surface with a radius $R_1$ on the internal diameter of the drum plate and a radius $R_2$ on the outer side, $R_2$ being greater than $R_1$. Under the influence of the pressure in the chamber and/or the rotation of the rotor 14, the drum sleeve 11 will to some extent roll along the contact surface 8, with a local gap of a few microns existing between the drum sleeve 11 and the contact surface 8. A film of oil will form in this gap, ensuring lubrication.

Figure 9:
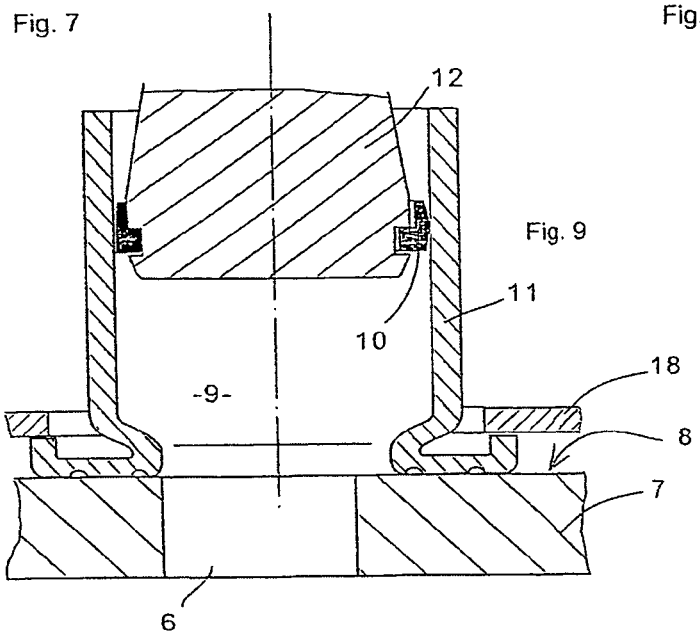
FIG. 9 shows an embodiment of a drum sleeve for use in the hydraulic device.
Figure 10:
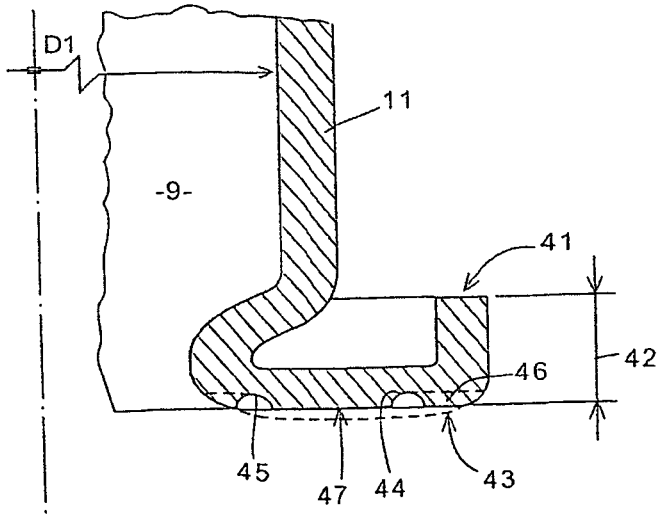
FIG. 10 shows a detail of the drum sleeve from FIG. 9.

FIGS. 9 and 10 show an embodiment of the drum sleeve 11 in which the latter has been produced by chipless deformation. With this production method, the drum sleeves 11 can be produced accurately and at low cost from sheet material by, inter alia, forcing the sheet material over a mandrel until it reaches the desired shape and dimensions. In this case, an internal diameter D2 is produced accurately, in such a manner that after hardening of the sleeve the diameter has the desired value. The forcing operation results in the formation of a bottom surface 43 of the sleeve which has a flange 41. For bearing in a sealed manner against the contact surface 8, the bottom surface 43 is accurately remachined to form a sealing surface 47, for example by grinding. For the flange 41 to bear against the sleeve holder 18, it is if appropriate also ground, so that the flange 41 is at a fixed distance 42 from the sealing surface 47.

In the sealing surface 47, there is a groove 44 which, via a passage 46, is in communication with the outer circumference of the drum sleeve 11. This allows a film of oil to form between the drum sleeve 11 and the drum plate 7 as discussed in connection with FIG. 3; in this embodiment, the diameter of the sealing surface 47 is larger than the diameter of the groove 44, so that the drum sleeve 11 has a larger surface area for support and tilting of the drum sleeve 11 is limited.

If appropriate, a groove 45 with a smaller diameter than the groove 44 may be arranged in the sealing surface 47. As a result, the surface area over which ++the decreasing pressure between the drum sleeve 11 and the drum plate 7 is active is accurately defined.

In the embodiments of the drum sleeve 11 discussed above, the drum sleeve 11 is designed as a component made from one material. If appropriate, the drum sleeve 11 may be made form two materials which are joined to one another, in which case that part of the drum sleeve 11 which forms the sealing surface 47 is made from a bronze-containing material, in order to reduce the friction. This friction results from the rotation and sliding of the drum sleeve 11 with respect to the drum plate 7. In this case, the shape of the join between the two components of the drum sleeve 11 and the elasticity of the materials are selected in such a manner that the join is closed up under the influence of the liquid pressure prevailing in the chamber 9.

Figure 11:
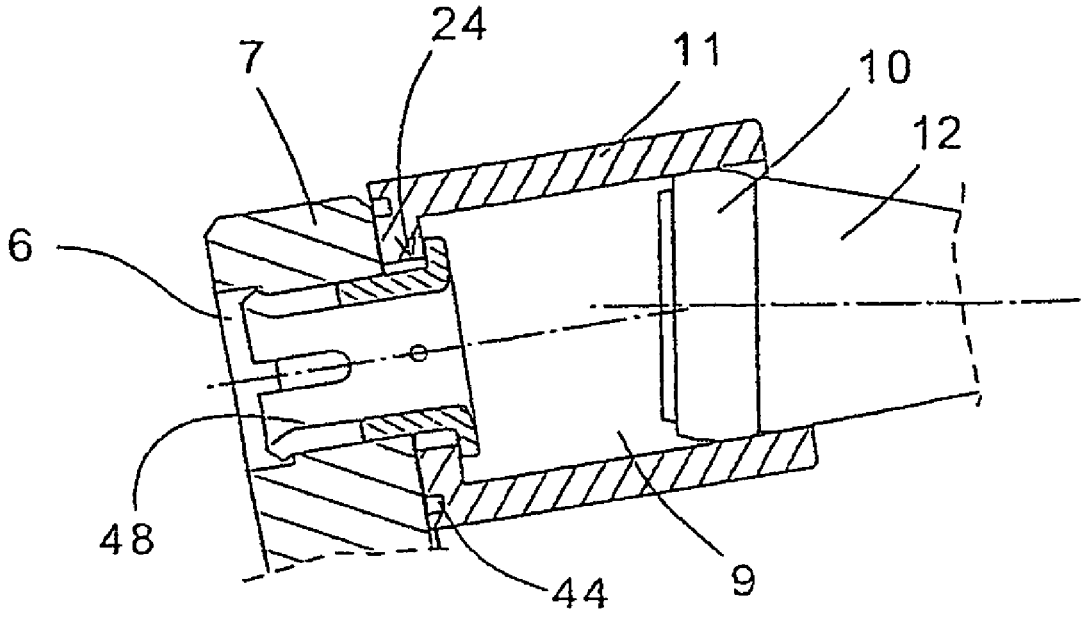
FIG. 11 shows a first embodiment of internal securing of the drum sleeve to the drum plate.
Figure 12:
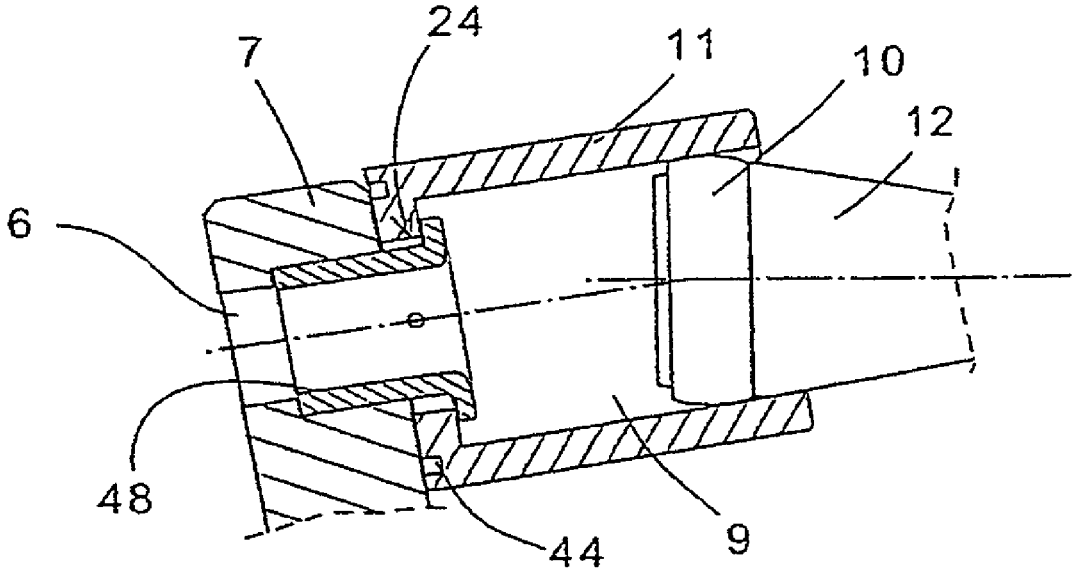
FIG. 12 shows a second embodiment of internal securing of the drum sleeve to the drum plate.

FIGS. 11 and 12 show alternative embodiments of the clamping device for clamping the drum sleeves 11 against the drum plate 7. In the embodiment shown above, the drum sleeves 11 are surrounded by the sleeve holder 18 on the outer side. In the event of rapid rotation of the rotor 14, high centrifugal forces are applied to a drum sleeve 11. If the liquid pressure in the chamber 9 is low, the drum sleeve 11 is only pressed onto the drum plate 7 by a low force, and there is then a risk of elastic deformation to the sleeve holder 18 as a result of the centrifugal force, which may give rise to unacceptable leaks occurring between the drum plate 7 and the drum sleeve 11. If the drum sleeve 11 is positioned, in the manner shown in FIGS. 11 and 12, with a clamping sleeve 48 in the vicinity of the drum plates 7, this drawback is avoided. The internal diameter of the drum-sleeve opening 24 is dimensioned in such a manner that the drum sleeve 11 can slide around the clamping sleeve 48 over the drum plate 7 in order to follow the piston 12, the drum sleeve 11 being axially enclosed between a collar of the clamping sleeve 48 and the drum plate 7. FIGS. 11 and 12 show two examples of the way in which the clamping sleeve 48 is secured in the drum plate 7. In this context, it is important for the clamping sleeve 48 to be accurately positioned in the axial direction with respect to the drum plate 7. In this case, it is preferable for the clamping sleeve 48 to be secured in the drum port 6. In the embodiment shown in FIG. 11, the clamping sleeve 48 is designed with resilient elements which clamp behind a rim in the drum port 6.

In the embodiment shown in FIG. 12, the clamping sleeve 48 is pressed onto a shoulder with a heavy press fit. In addition to the embodiments of the clamping sleeve 48 which are shown, it will be clear to the person skilled in the art that the same technical effect can also be achieved with other embodiments.

FIG. 13 shows a hydraulic pump or motor which is designed in a similar way to the hydraulic transformer which has been described with reference to FIGS. 1-4, and the corresponding components are provided with identical reference numerals. The pump or motor is composed of a housing 61 and a cover 55. Bearings 1 are mounted in the housing 61 and the cover 55, and the rotor shaft 2 can rotate with an axis of rotation 1 in the bearings 1. In the cover 55 there is an opening through which a shaft end 51 projects in order to couple the shaft 2 to a motor or a tool. There is a seal 53 arranged between the shaft end 51 and the cover 55. A rotor 14, in which the pistons 12 are arranged on either side, is positioned between the bearings 1 on the shaft 2. This pistons 12 move, in a manner which has already been discussed above in the drum sleeves 11 which are coupled to the drum plates 7. The drum plates 7 are coupled to the rotor shaft 2 and rotate with it, being supported against the face plates 4. The surface between the face plate 4 and the drum plate 7 is in this case not at right angles to the axis of rotation 1. The face plates 4 are mounted in the manner shown in FIG. 4*a* and are provided at a lowest point with a locking hole 52 which interacts with a pin which is mounted in housing 61 or cover 55 and thereby determines the rotational position of the face plate 4.

There are two face-plate ports arranged in each face plate 4: a low-pressure port, which is connected via a connection passage 54 and a low-pressure line 59 to a low-pressure connection T, and a high-pressure port, which is connected via a connection passage 54 and a high-pressure line 62 to a high-pressure connection P.

In the embodiment shown, the connection passages 54 are of approximately equal length before they meet at 60 and pass into the low-pressure line 59 or the high-pressure line 62. The chambers 9 in the drum sleeves 11 on either side of the rotor 14 are alternately connected to the two converging connection passages 54, and therefore, in the event of unfavorable conditions, it is possible that the oil may start to resonate at 60, which can lead to pressure peaks and excessive noise in the low-pressure line 59 and/or the high-pressure line 62. There is also a risk of excessive noise when using hydraulic transformers with three pressure lines.

To limit this excessive noise, there are resonance dampers, as shown in FIG. 13, if appropriate in each connection passage 54. Each resonance damper comprises a chamber 57 which is filled with oil and is connected, by means of a passage 56 of small cross section, to the connection passage 54. The oil-filled chamber 57 is formed by a cavity in A cover 58 which is secured in the housing 61 or the cover 55. The dimensions of the chamber 57 and the passage 56 are matched to the frequency of the pressure pulses which occur and the properties of the oil. Suitable selection of these parameters makes it possible, for example, to reduce the pulses in the high-pressure line 62 in a pump from 50 bar to approximately 1-3 bar.

FIG. 14 shows a hydraulic pump or motor in which the length of the connection passages 54 leading to the face plates 4 differs on the two sides of the rotor 14.

The pressure pulses are likewise limited in this way, albeit to a lesser extent, for example the pulses which occur in the pressure line 62 of a pump are reduced from 50 bar to pulses of 1-3 bar. However, this method has the advantage that the influence of the properties of the liquid is reduced. If appropriate, it is also possible for the resonance dampers as shown in FIG. 13 also to be used in the connection passages 54 as shown in FIG. 14.

The designs for reducing excessive noise in the case of a double hydraulic pump or motor may, of course, also be used where necessary to reduce the pulses which may arise in a double hydraulic transformer.

In the exemplary embodiments of the hydraulic device which have been discussed above, the figures have always shown a device with drum sleeves 11 which, during rotation, describe an elliptical path and pistons 12 which describe a circular path. It will be clear to the person skilled in the art that a number of the design details discussed can also be used in other known designs, such as designs in which the drum sleeves are assembled to form a drum and the pistons are arranged in such a manner that they can be pivoted or displaced into or onto a drum, or designs in which the drum sleeves 11 can move over the face plate 4 and a drum plate 7 is not used. Other designs which can also be combined with the exemplary embodiments described here are designed with a variable displacement, for example achieved by making the angle β variable.

What is claimed is:

1. Hydraulic device comprising a housing, a rotor rotatable about a first axis (l), said rotor having a first side and a second side, a plurality of pistons on said first side and said second side of the rotor and coupled to the rotor, a plurality of rotor chambers on said first side and said second side of the rotor, each being formed by a cylindrical wall and a piston whereby the cylindrical walls are rotatable about secondary axes ($m_1$, $m_2$), and the first axis intersecting each secondary axis on either side of the rotor under a first angle (β) causing the volume of the chambers to change between a minimum and a maximum value during rotation of the rotor, characterized in that during rotation of the rotor the volume of each of the rotor chambers reaches a minimum value at a different rotative position of the rotor than all of the other chambers.

2. Hydraulic device according to claim 1 whereby the first axis (l) and the secondary axes ($m_1$, $m_2$) are in a common plane (V) and the pistons on either side of the rotor are arranged offset to one another.

3. Hydraulic device according to claim 1 whereby a first plane ($V_1$) is formed by the first axis (l) and one secondary axis ($m_1$) and a second plane ($V_2$) is formed by the first axis and the other secondary axis ($m_2$) and the first plane ($V_1$) and the second plane ($V_2$) make a second angle ($\alpha$) with one another.

4. Hydraulic device according to claim 3 whereby if the number of pistons on either side of the rotor is equal to n, the second angle ($\alpha$) is equal to (1+2k)*180°/n, where k is equal to 0 or an integer number.

* * * * *